US008631725B2

(12) United States Patent
Tuan-Mu

(10) Patent No.: US 8,631,725 B2
(45) Date of Patent: Jan. 21, 2014

(54) RATCHETABLE OPEN-ENDED WRENCH

(75) Inventor: Hsien-Chung Tuan-Mu, Taichung (TW)

(73) Assignee: Apex Tool (HK) Limited Taiwan Branch, Taichung (TW)

( * ) Notice: Subject to any disclaimer, the term of this patent is extended or adjusted under 35 U.S.C. 154(b) by 0 days.

(21) Appl. No.: 12/136,132

(22) Filed: Jun. 10, 2008

(65) Prior Publication Data

US 2009/0272236 A1 Nov. 5, 2009

(30) Foreign Application Priority Data

Apr. 30, 2008 (TW) ..... 97115950 A

(51) Int. Cl.
*B25B 13/12* (2006.01)

(52) U.S. Cl.
USPC ..... 81/179; 81/126; 81/186

(58) Field of Classification Search
USPC ..... 81/179, 126, 186
See application file for complete search history.

(56) References Cited

U.S. PATENT DOCUMENTS

| | | | | |
|---|---|---|---|---|
| 1,308,440 A | * | 7/1919 | Morrison | 81/179 |
| 1,898,388 A | | 2/1933 | Parker | |
| 2,652,735 A | | 9/1953 | Wilder | |
| 2,700,315 A | * | 1/1955 | Hermanson | 81/183 |
| 2,730,000 A | * | 1/1956 | Crittenden, Jr. | 81/179 |
| 2,795,160 A | | 6/1957 | Blasdell | |
| 2,855,814 A | * | 10/1958 | Yavner | 81/179 |
| 2,879,681 A | | 3/1959 | Blasdell | |
| 2,910,902 A | | 11/1959 | Akers | |
| 2,937,551 A | * | 5/1960 | Akers | 81/179 |
| 3,079,820 A | * | 3/1963 | Vantchoura | 81/179 |
| 3,165,015 A | | 1/1965 | Hinrichs | |

(Continued)

FOREIGN PATENT DOCUMENTS

| | | |
|---|---|---|
| CN | 2057881 U | 6/1990 |
| CN | 2317047 Y | 5/1999 |

(Continued)

OTHER PUBLICATIONS

Taiwan Patent Office Search Report for Application No. 097115950, dated Aug. 25, 2010.

(Continued)

*Primary Examiner* — Robert Scruggs
(74) *Attorney, Agent, or Firm* — Nelson Mullins Riley & Scarborough, LLP

(57) ABSTRACT

A ratchetable open-ended wrench includes a handle H for a hand to grasp, a wrench head 100 located on one end of the handle, and a fastener room 160 located in the wrench head 100 for accommodating a workpiece W to be rotated. The wrench head 100 further includes a first jaw 110 having a first driving wall 114, a second jaw 120 having a second driving wall 124 facing the first driving wall 114, an inner wall 126 extending from the second driving wall 124 into the second jaw 120, a fastener-jaw room 128, an auxiliary jaw retracting opening 13, an auxiliary jaw 140 capable of longitudinally sliding into the auxiliary jaw retracting opening 130 in an elastic way, and an auxiliary jaw limiting member 150 coupled to a limiting slot 148. The auxiliary jaw 140 further includes an exterior end 142 having a pillow 142 in contact with the driving wall 126 and a pushing surface 144 for working together with the first jaw 110 to grip the workpiece W under operation, an interior end 146, and a limiting slot 148.

19 Claims, 4 Drawing Sheets

(56) References Cited

U.S. PATENT DOCUMENTS

| | | | | | |
|---|---|---|---|---|---|
| 3,717,054 | A * | 2/1973 | Thompson | 81/179 |
| 4,554,847 | A | 11/1985 | DeSantis | |
| 4,644,830 | A * | 2/1987 | Bailey et al. | 81/58.2 |
| 4,706,528 | A * | 11/1987 | Inoue | 81/179 |
| 5,533,428 | A | 7/1996 | Pradelski | |
| 5,768,958 | A | 6/1998 | Gamble | |
| 6,637,300 | B2 | 10/2003 | Wu | |
| 7,010,999 | B1 | 3/2006 | Wu | |
| 7,077,035 | B1 * | 7/2006 | Huang | 81/179 |
| 7,082,859 | B2 | 8/2006 | Huang | |
| 7,082,862 | B2 | 8/2006 | Lee | |
| 7,111,529 | B2 | 9/2006 | Pradelski | |
| 7,661,337 | B2 | 2/2010 | Chen | |
| 2007/0119281 | A1 | 5/2007 | Chang | |
| 2008/0066585 | A1 | 3/2008 | Chiang | |
| 2010/0083797 | A1 | 4/2010 | Lee | |

FOREIGN PATENT DOCUMENTS

| | | | |
|---|---|---|---|
| CN | 2868567 | Y | 2/2007 |
| DE | 10204805 | | 8/2003 |
| DE | 202005019936 | | 2/2006 |
| EP | 2113340 | A2 | 11/2009 |
| TW | 124725 | | 12/1989 |
| TW | 22875 | | 8/1994 |
| TW | 278060 | | 6/1996 |
| TW | 327619 | | 3/1998 |
| TW | 501515 | | 9/2002 |
| TW | 511564 | | 11/2002 |
| TW | M262313 | | 4/2005 |
| TW | M291345 | | 6/2006 |
| TW | 200637692 | | 11/2006 |
| TW | M310772 | | 5/2007 |
| TW | M316132 | | 8/2007 |
| TW | 2000800509 | | 1/2008 |
| WO | WO 96/15879 | | 5/1996 |

OTHER PUBLICATIONS

Office Action dated Feb. 28, 2012 for co-pending European Patent Application No. EP 08104349.9.

Office Action dated May 15, 2013 for corresponding U.S. Appl. No. 13/735,590.

European Patent Office Search Report dated Oct. 28, 2009 regarding co-pending EP Application No. 09159662.7.

Office Action dated May 20, 2011 regarding co-pending U.S. Appl. No. 12/418,188.

Amendment filed Jun. 29, 2011 for Office Action dated May 20, 2011 regarding co-pending U.S. Appl. No. 12/418,188.

* cited by examiner

RATCHETABLE OPEN-ENDED WRENCH

FIELD OF THE INVENTION

The present invention relates to a ratchetable open-ended wrench which allows application of sequential back and forth strokes to a rotatable workpiece W without removing the wrench from the workpiece, and more particularly to a ratchetable open-ended wrench that achieves a "smooth, continuous operation" for the operators when retracting a workpiece W with sequential back and forth strokes.

BACKGROUND OF THE INVENTION

A ratchetable open-ended wrench is known as an improved hand tool which not only achieves the functions of conventional open-ended wrench but also provides the advantage of ratchetable operation. In view of the convenience, efforts and improvements have been made in this field, for example, Patent Nos. TW228757, TW278060, TW327619, U.S. Pat. No. 5,533,428 (WO9615879), TWM310772, U.S. Pat. Nos. 7,111,529, 7,077,035 and 3,165,015. Further, some adjustable spanners are also provided with similar ratchetable operation mechanism, such as Patent Nos. TW501515, TW511564, U.S. Pat. No. 7,010,999, TW262313, and U.S. Pat. No. 2,879,681.

TW228757 discloses an open-ended wrench which allows application of sequential back and forth strokes for driving a screw/workpiece. The wrench relies on a pair of retractable claws/jaws (2, 3) parallel to each other and disposed in the wrench head, which move along the same direction as a pair of drive springs coupled to the claws/jaws. Therefore, TW228757, which is characterized by the retractable claws/jaws (2, 3) moving back or forth along the activation direction of the springs, can rotate a screw clockwise, and turn back in a counterclockwise direction without rotating the screw. However, a wrench needs the counterforce or friction from the retractable claws/jaws, which are abutted against the screw, to tighten or loosen the screw. In this regard, the retractable claws/jaws (2, 3) of the wrench of TW228757 are formed with toothed surfaces which are parallel to each other to contact a parallel pair of sides of the screw so as to rotate the same. The problem with the wrench is that, since the toothed surfaces of the jaws are substantially parallel to each other and are not perpendicular to the screw sides, the tightening/loosening performance of the wrench is poor, and the toothed structure can be easily abraded after long-term usage. Moreover, due to the complicated jaw-pair structure, the jaw opening (the opening between the jaws) of the wrench must be made larger than the size of the screw/workpiece to be driven, and the retractable claws/jaws (2, 3) may be continuously abraded during operation. Therefore, such a wrench is inconvenient in use. Nevertheless, the through slots (111, 121) accommodating the claws/jaws weaken the wrench head structure.

U.S. Pat. No. 5,533,428 (WO9615879) and TW327619 remedy some of the above defects by providing a wrench providing a single L-shaped retractable claw/jaw 15 which moves in the same direction as a driving spring coupled therewith in a slot 23 inward facing a base portion of the wrench driving head which is near a handle 21, with a modified driving head structure. The retractable jaw 15 has a second engaging surface 14 in parallel to a first engaging surface 13 on a first jaw 11. However, the problem with this wrench is that, during the wrench "reverse rotation" at which the nut is not rotated, the wrench cannot be operated smoothly. One reason is that, the wrench reverse rotation is easily held up because a corner 75 of the nut 60 will block the retracting action of the retractable jaw 15 may tend to block the retractable jaw member 15. Though the inventions provide a chamfered edge 16 between forward surface 30 and engaging surface 14 to allow for improved ratchetability of the retractable jaw 15 to alleviate the above problem, there remain some other defects. Specifically, the driving opening of the wrench driving head is characterized by a complicated structure including bearing surface 50 and recesses 51-53 which are not smoothly connected to each other, and the jaw opening must be larger than the nut/screw/workpiece to be driven, which results in an increased weight of the wrench and inaccurate sizing of jaw opening. Besides, since the driving opening is not smoothly contoured with bearing surface 50 and recesses 51-53, during the wrench reverse rotation when the nut is not rotated, a series of sequential partial-turn strokes are required to find different points for force application. This slows the rate of each wrench reverse rotation operation. Therefore, such a wrench is very inconvenient for a professional user.

The aforementioned or similar problems exist in various other conventional wrenches, such as TWM310772, U.S. Pat. Nos. 3,165,015, 7,077,035 and 7,111,529 which use a retractable claw/jaw moving in the same direction as a driving spring coupled therewith. Another common problem of conventional wrenches is that during the tightening/loosening operation, the spring and the retractable claw/jaw directly bear a great torque, which may adversely affect the wrench service life.

U.S. Pat. No. 6,637,300 (TW501515), U.S. Pat. No. 7,010,999 (TW200637692) and TW511564 issued to Arthur Wu disclose ratchetable adjustable spanners which adopt "pivot-type claw/jaws." In particular, U.S. Pat. No. 6,637,300 discloses slots 14 which laterally penetrate a fixed jaw 11, and rotatable devices (pivoted jaws) 40, 66 with a symmetrical, paired structure pivotally fixed in said two slots 14, so that the rotatable devices 40, 66 can be clamped between stopping portions 15. With the above structure, the wrench can tighten/loosen a screw in one direction, and turn back without rotating the screw in the opposite direction. However, U.S. Pat. No. 6,637,300 has the following disadvantages: (1) The rotatable devices (pivoted claws) 40, 66 are complicated by providing symmetrical, T-shaped and paired structures. (2) The rotatable devices 40, 66 is clamped between the two stopping portions 15 cannot be retracted into the slots 14 receiving said rotatable devices 40, 60, so the wrench driving opening must be made larger, which results in an increased weight, and the ratachetable structure can only be used with an "adjustable spanner" instead of an "open-ended wrench." (3) The springs 50, 67 are disposed on a pivot, so the rebounding force of the rotatable devices 40, 66 is small, and the operation performance is not good. (4) The slot 14 for accommodating the rotatable devices 40, 66 penetrates the head portion of the wrench, which weaken the strength of the wrench head. TW511564 and U.S. Pat. No. 7,010,999 (TW 200637692) change the through slot 14 of U.S. Pat. No. 6,637,300 to an arcuated, C-shaped opening to acquire a higher strength, and change the "rotatable devices (pivoted claws) 40, 66" of TW501515 with "driving rollers" activated by springs. These driving rollers are big, however. To accommodate the "driving rollers," the fixed jaw must be made larger. Moreover, the above prior arts are only applicable to an adjustable spanner which is equipped with a "moving jaw" and a "worm," so that these elements can actually engage a screw/nut/workpiece. Thus, the whole adjustable spanner with these elements is even more clumsy and inconvenient to operate.

Among various ratchetable wrenches, those with a retractable jaw moving in the same direction as a driving spring coupling therewith are simpler in structure than those with a pivot-type jaw, and thus have a lower cost. However, the conventional design of the former is highly complicated and has the following disadvantages. (1) The retractable jaw must work with a slot penetrating the fixed jaw of the wrench head, which results in a weak wrench head structure that may be easily ruptured under a great torque for a long time. (2) To engage fasteners or workpieces such as screws/nuts, the wrench is provided with a retractable jaw which is usually designed with a complicated engaging surface, or provided with several retractable jaws working together, so the difficulty in and cost of the fabrication are increased. (3) The retractable jaw is not properly designed to bear great force, and is easily broken. (4) The wrench driving opening/fastener room for accommodating a fastener or workpiece such as a screw/nut has a complicated structure, which brings inconvenience during operation.

Therefore, it is necessary to provide a ratchetable open-ended wrench to eliminate the above disadvantages.

SUMMARY OF THE INVENTION

Accordingly, the present invention is directed to a ratchetable open-ended wrench, which includes a handle for a hand to grasp, a wrench head located on one end of the handle, and a fastener room located in the wrench head for accommodating a workpiece to be rotated. The wrench head further includes a first jaw having a first driving wall, a second jaw having a second driving wall facing the first driving wall, an inner wall extending from the second driving wall toward the inside portion of the second jaw, a fastener-jaw room, an auxiliary jaw retracting opening, an auxiliary jaw elastically and longitudinally slidable along the auxiliary jaw retracting opening, and an auxiliary jaw limiting member coupled with the limiting slot. The auxiliary jaw further includes an exterior end having a pillow in contact with the inner wall and a pushing surface for working together with the first jaw to grip and rotate the workpiece W, an interior end, and a limiting slot.

BRIEF DESCRIPTION OF THE DRAWING

FIG. 2B is a plane view of FIG. 1B the present invention of;

DETAILED DESCRIPTION OF THE INVENTION

Figure 1A:
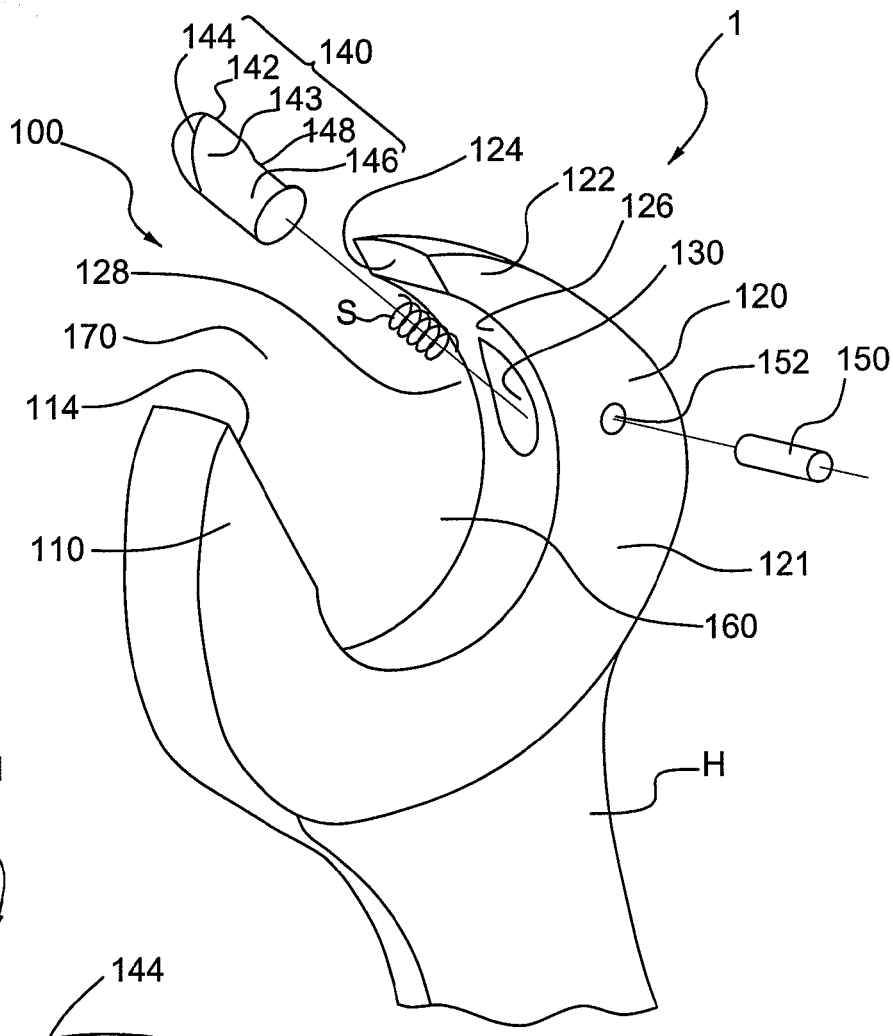
FIGS. 1A to 1B are schematic three-dimensional views of the present invention.
Figure 1B:
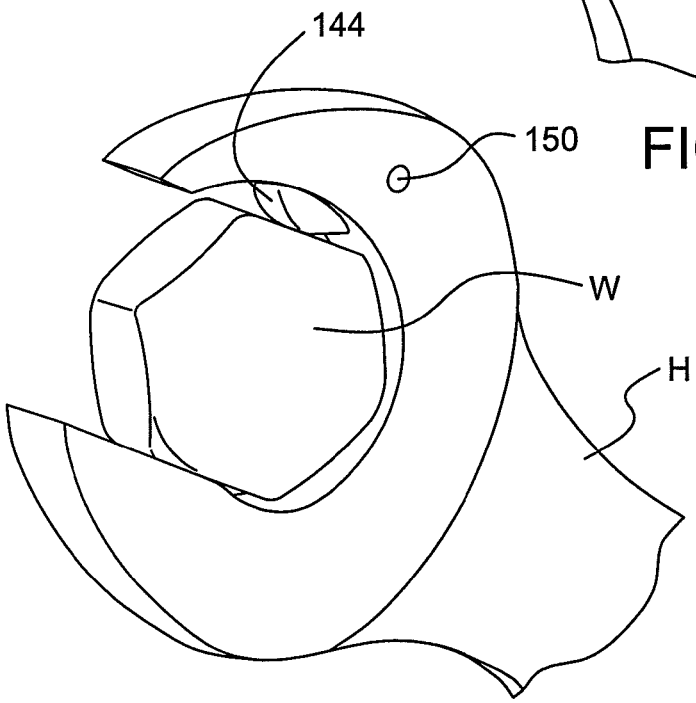

In FIGS. 1A to 2B, a preferred embodiment of a ratchetable open-ended wrench 1 for turning a rotatable workpiece W is shown. The "workpiece" refers to, for example, a fastener like screw/nut, or any other hand tool having a polygonal driven part and capable of being driven by a wrench. However, the workpiece W hereinafter only stands for to the driven part of the workpiece W (e.g., a bolt head or a driven end of an adaptor) that is driven by the wrench. The ratchetable open-ended wrench 1 substantially comprises a handle H for a hand to grasp and a wrench head 100 for rotating the workpiece W, which includes a drive opening therein and located on one end of the handle H.

The wrench head 100 preferably includes a first jaw 110 having a first driving wall 114, a second jaw 120 substantially extending from a base portion 121 of the wrench head 100 adjoining the handle to a free end 122, and a fastener room 160 located in the drive opening of the wrench head 100 for accommodating the workpiece W to be rotated.

The first jaw 110 is preferably formed with a recessed portion 112 capable of accommodating the angled portion of the workpiece W is an inner section (a section away from the first driving wall 114) thereof (see FIG. 2A) to facilitate smooth operation during the reverse rotation of the wrench at which the workpiece W is not rotated. According to an alternative embodiment, the recessed portion 112 of the first jaw 110 may be omitted, and the inside portion of the second jaw 120 is made larger so as to accommodate the workpiece W during the reverse rotation of the wrench without rotating the workpiece W. In this alternative embodiment, although the weight of the wrench is increased, the functions of the wrench of the present invention can still be achieved.

The second jaw 120 comprises:

- a second driving wall 124, formed on the free end 122 of the second jaw 120 and facing the first driving wall 114;
- an inner wall 126, extending from the second driving wall 124 toward the inside portion of the second jaw 120;
- a fastener-jaw room 128 in the drive opening of the wrench head 100 and near the inner wall 126, preferably substantially disposed between the extending line of the second driving wall 124 and the inner wall 126;
- an auxiliary jaw retracting opening 130, which extends from the base portion 121, faces a jaw opening 170 (which will be explained below) and adjoins the fastener-jaw room 128, wherein the auxiliary jaw retracting opening 130 preferably does not penetrate the second jaw 120;
- an auxiliary jaw 140, partially disposed in the auxiliary jaw retracting opening 130, and elastically (see a spring S in the drawings) and longitudinally slidable along the auxiliary jaw retracting opening 130;
- an interior end 146 for elastically coupled to the auxiliary jaw retracting opening 130 (with the spring S);
- a limiting slot 148; and
- an auxiliary jaw limiting member 150, extending (from a surface of the second jaw 120) through an opening 152 to the auxiliary jaw retracting opening 130, and coupled with the limiting slot 148, for confining the auxiliary jaw 140 to move between a first position in which the auxiliary jaw 140 is unbiased and a second position in which the auxiliary jaw 140 is biased.

Figure 2A:
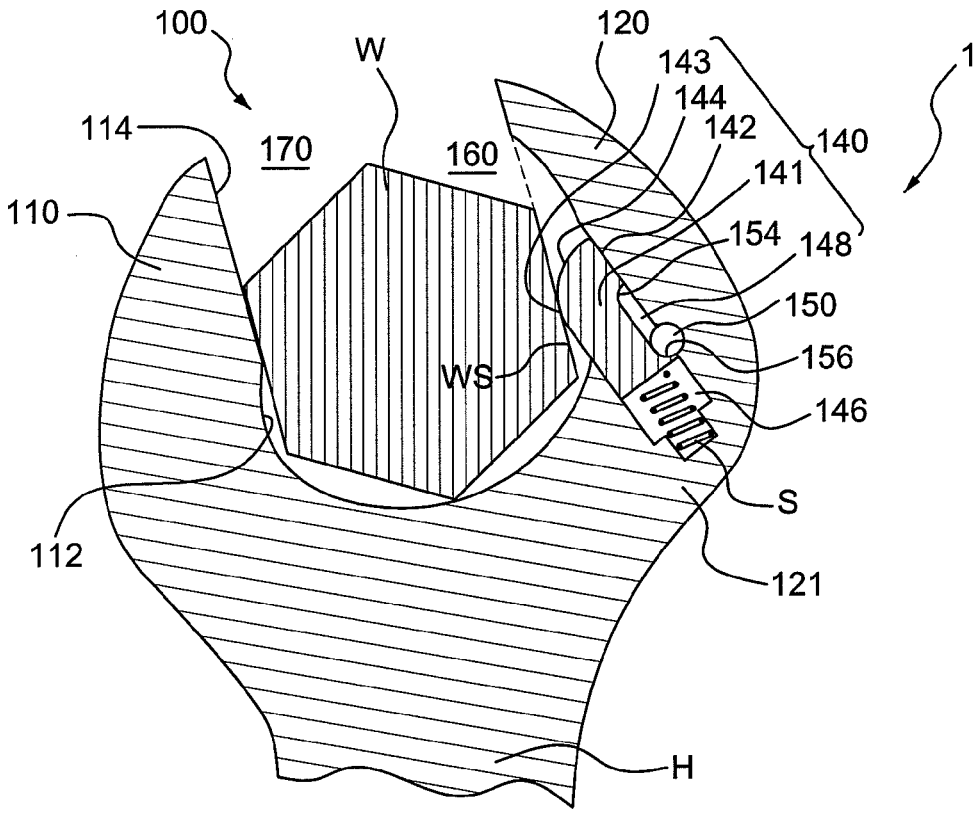
FIG. 2A is a plane view of the present invention.
Figure 2B:
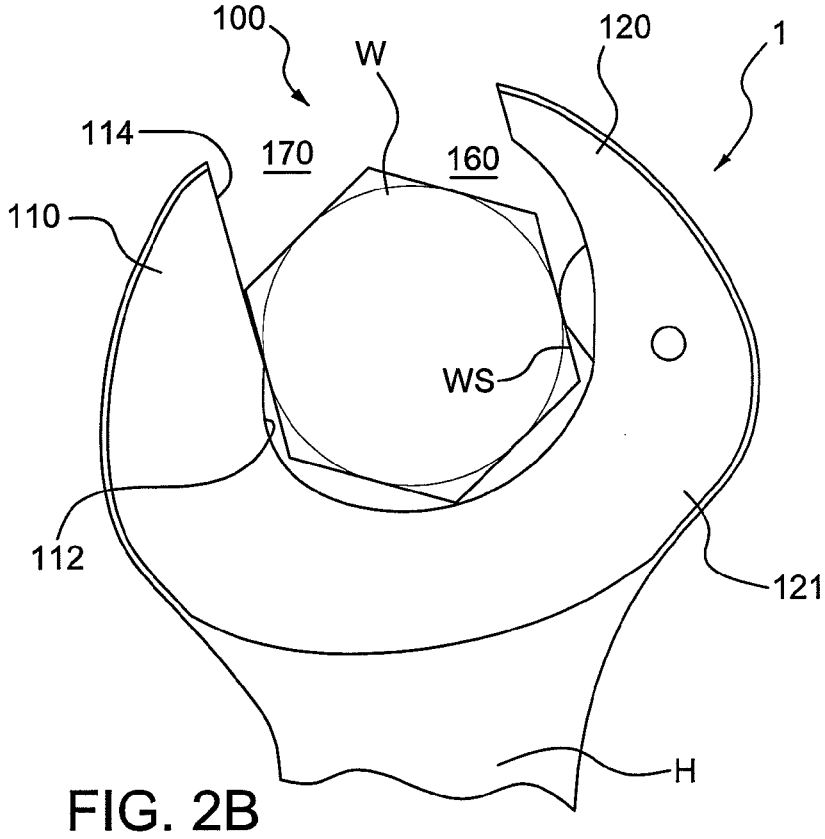

The auxiliary jaw 140 preferably comprises a pillow 142 facing the inner wall 126 for contacting/abutting it and a "fastener contact surface" for contacting the workpiece W. The "fastener contact surface" comprises a driving surface 143 and a pushing surface 144. Preferably, when the auxiliary jaw 140 is located in the first position in which the auxiliary jaw 140 is unbiased and fully extended by spring S, the minimum width between the "fastener contact surface" thereof and the first driving wall 114 of the first jaw 110 is substantially equal to the size of the workpiece W. As preferably shown in FIG. 2A, the driving surface 143 substantially faces a portion of a workpiece contact edge WS that is adjacent to the base portion 121 (which means that the driving surface 143 faces a lower portion of the contact edge WS of the workpiece W to be rotated, as shown in FIG. 2A), so that it can work with the first jaw 110 to grip the workpiece W and apply a force (torque) thereto during operation. The pushing surface 144 substantially faces another portion of the workpiece contact edge WS that is away from the base portion 121 (which means that the pushing surface 144 faces an upper portion of the contact edge WS, as shown in FIG. 2A), so that it can be pushed by the upper portion of the contact edge WS of the workpiece W to be rotated when the ratchetable open-ended wrench 1 is ratcheted back with no loosening/tightening action, while at the same time the auxiliary jaw 140 is retracted into the auxiliary jaw retracting opening 130 as workpiece W enters the fastener-jaw room 120. The pushing surface 144 preferably includes a gentle cambered/curved surface. The driving surface 143 is connected to the pushing surface 144 preferably by a smooth cambered/curved surface. More specifically, the "fastener contact surface" of the auxiliary jaw 140 extends with a curved surface from the driving surface 143 to the pushing surface 144 (that is, the pushing surface 144 itself has a cambered/curved surface, and the pushing surface 144 is connected to the driving surface 143 by a cambered/curved surface), thereby making the workpiece W smoothly slide from the driving surface 143 to the pushing surface 144. With this configuration, when the ratchetable open-ended wrench 1 is ratcheted back without rotating the workpiece W from a gripping position (holding the workpiece W), a smooth, continuous operation can be obtained. Accordingly, users who tighten/loosen the workpiece W by the ratchetable open-ended wrench 1 of the present invention can perform a series of smooth, continuous operation steps, including inserting the ratchetable open-ended wrench 1 to the workpiece W, rotating the workpiece W by the wrench 1, and ratcheting the wrench 1 back without loosening/tightening the workpiece W. Compared with prior art references such as U.S. Pat. Nos. 5,533,428 and 7,111,529 in which the back-ratcheting rotation require a series of sequential partial-turn strokes which are not continuous or smooth due to the complicated wrench head structures (in these patents, users must partially "move" the wrench during back-ratcheting operation of the wrench to find appropriate positions for force application), the present invention significantly improves back-ratcheting operation of the wrench.

The limiting slot 148 is preferably in the form of a longitudinal notch located on one side of the auxiliary jaw 140, and defined between a shoulder 154 of the pillow 142, a shoulder 156 of the interior end 146, and the inner wall 126. According to this embodiment, the limiting slot 148 is a notch having a U-shaped structure near a side of the auxiliary jaw 140, and is surrounded by the inner wall 126 so as to work as a groove/slot. With this structure, the auxiliary jaw limiting member 150 is coupled in the limiting slot 148, so that auxiliary jaw 140 moves between a first position (at which the auxiliary jaw 140 is unbiased by the workpiece W and fully extended by the spring S) and a second position (in which the auxiliary jaw 140 is biased and fully compressed by the workpiece W), due to the blocking of the shoulders 154 and 156. As further shown in FIG. 2C, in another embodiment of the present invention, the limiting slot 148 is a longitudinal notch substantially located in the auxiliary jaw 140 and spaced a distance from the periphery of the auxiliary jaw 140 and the inner wall 126.

Figure 2C:
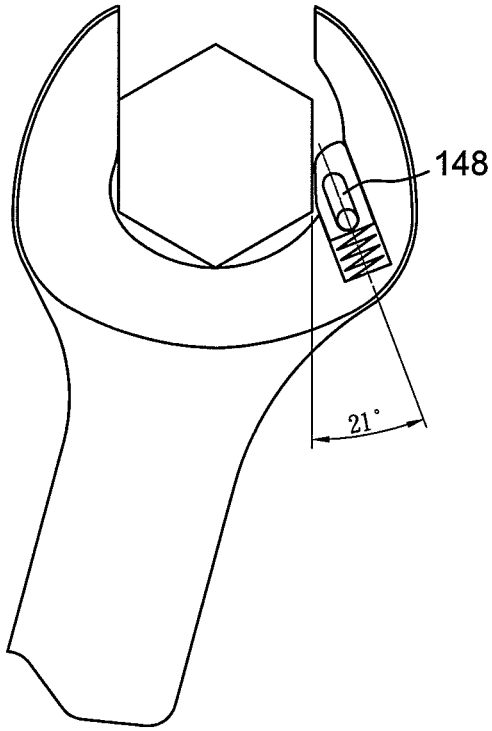
FIG. 2C is a plane view showing another embodiment of the present invention using a limiting slot 148 in the form of a longitudinal notch substantially located in the auxiliary jaw 140.
Figure 2D:
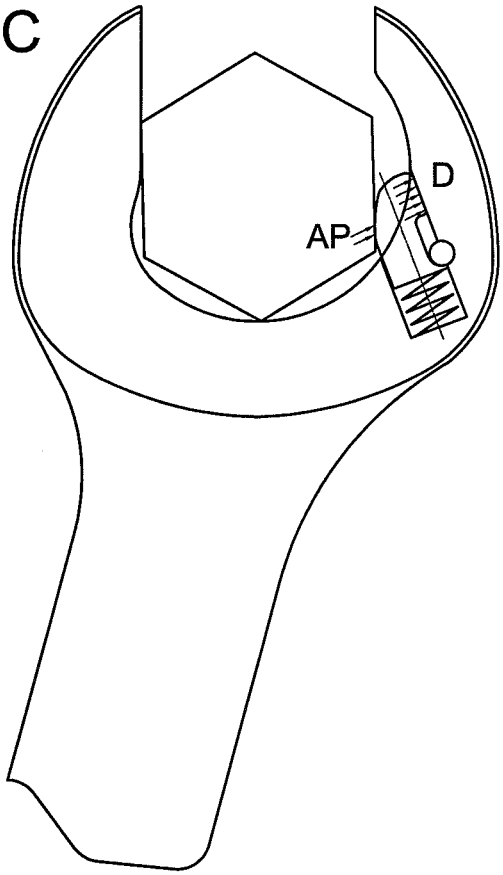
FIG. 2D is a schematic view showing an area of reaction when the auxiliary jaw grips and rotates the workpiece.

In order to achieve a better effect, the ratchetable open-ended wrench 1 is configured so that, when the auxiliary jaw 140 is located at the first position, the contact point between the driving surface 143 and the contact edge WS of the workpiece W to be rotated is substantially located at or slightly lower than the middle point of the contact edge WS of the workpiece W. According to a preferred embodiment, when the auxiliary jaw 140 is located in the first position, the included angle between the driving surface 143 (or the contact edge WS) and a longitudinal centerline of the auxiliary jaw 140 (or of is the auxiliary jaw retracting opening 130) is smaller than 35°, preferably smaller than 25°. FIG. 2C illustrates a preferred embodiment in which the included angle is 21°. This is advantageous in that, when the user uses the ratchetable open-ended wrench 1 to rotate (tighten or loosen) the workpiece W, at least a large part of or the overall torque on the auxiliary jaw 140 is converted into a component force along the radial direction of the auxiliary jaw 140, so as to press the auxiliary jaw 140 against the wall of the auxiliary jaw retracting opening 130, thus making it easier to drive the workpiece W (see FIG. 2D, which is a schematic view of area of reaction). In another preferred embodiment, the pushing surface 144 of the auxiliary jaw 140 extends from an end adjacent to the inner wall 126 to the driving surface 143 preferably shaped as a gentle cambered/curved surface. With this feature, during the back-ratcheting operation of the wrench 1 without rotating the workpiece W, a direction of force application between the contact edge WS of the workpiece W and the pushing surface 144 is mostly or almost parallel to the longitudinal centerline of the auxiliary jaw 140 (or of the auxiliary jaw retracting opening 130), so all or most of the force applied to the pushing surface 144 can be parallel to the longitudinal centerline of the auxiliary jaw 140, thus reducing the abrasion between the pillow 142 and the inner wall 126.

The fastener room 160 is used to accommodate the workpiece W to be rotated, which is substantially located between the auxiliary jaw 140 and the first driving wall 114, and adjoins the fastener-jaw room 128. The fastener room 160 and the fastener-jaw room 128 work together in such a way that they form a working space which is sufficiently large to allow the workpiece W to remain therein for a full 360-degree turn of the wrench head 100/handle H. Therefore, whenever the ratchetable open-ended wrench 1 is operated to rotate the workpiece W or is ratcheted back without rotating the same, there is no need to remove the wrench 1 from the workpiece W. That is, the steps of rotating the workpiece W by the wrench 1 and ratcheting the wrench 1 back without rotating the workpiece W can be completed with the workpiece W remaining in the working space formed by the fastener room 160 and the fastener-jaw room 128.

A jaw opening 170 is defined between the first driving wall 114 of the first jaw 110 and the second driving wall 124 of the second jaw 120. The width of the jaw opening 170 is substantially the same as the size of the workpiece W to be rotated, so that the first jaw 110 together with the second jaw 120 may tighten/loosen the workpiece W as a typical open-ended wrench.

In prior art references such as U.S. Pat. No. 7,111,529, in order to provide the function of back-ratcheting rotation without loosening/tightening action, the width of the jaw opening of the wrench must be larger than the workpiece W (i.e., the size of the jaw opening is inconsistent with that of the workpiece W) with the complicated structure of the fastener room and the auxiliary jaw 11 facing the base area 19. Moreover, cover plates 23, 25 and a welding process are required. An advantage of the present invention is that the width of the jaw opening 170 can be made substantially the same size as that of the workpiece W to be rotated. This allows the appearance and size of the wrench head 100 of the ratchetable open-ended wrench 1 of the present invention to be almost identical to those of conventional open-ended wrenches without ratchetable functions. The ratchetable open-ended wrench 1 can be manufactured with less material, and can be applied to small-sized wrenches for small workpieces W. Further, as indicated above, according to the present invention, the minimum width between the "fastener contact surface" of the auxiliary jaw 140 and the first driving wall 114 of the first jaw 110 may be substantially equal to the size of the workpiece W. Thus, the overall operation, including gripping the workpiece W with the jaw opening 170 of the ratchetable open-ended wrench 1, rotating the workpiece W by the wrench 1, ratcheting the wrench 1 back without loosening/tightening the workpiece W, and again rotating the workpiece W again, is very smooth. Another advantage is that the auxiliary jaw retracting opening 130 of the present invention is formed in the base portion 121, which does not need the cover plates of U.S. Pat. No. 7,111,529 or a welding process. The above advantages are a great improvement as compared with the prior arts.

Figure 3A:
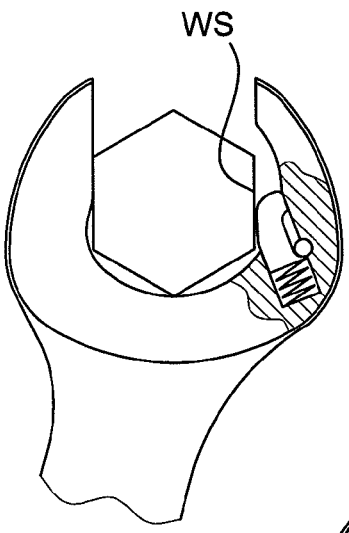
FIGS. 3A to 3E are schematic views showing the wrench reverse rotation operation during which the workpiece is not rotated according to the present invention.
Figure 3B:
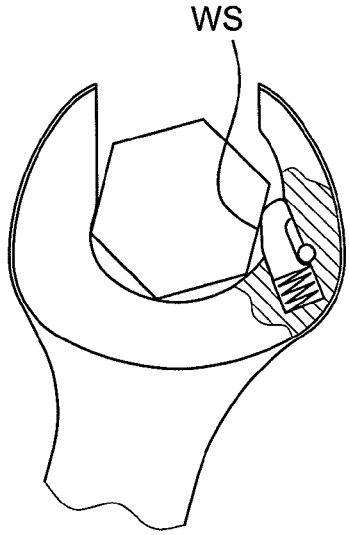
Figure 3C:
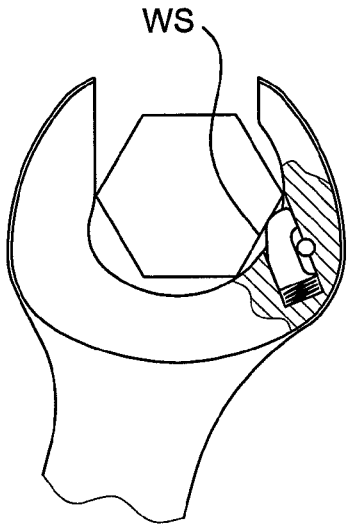
Figure 3D:
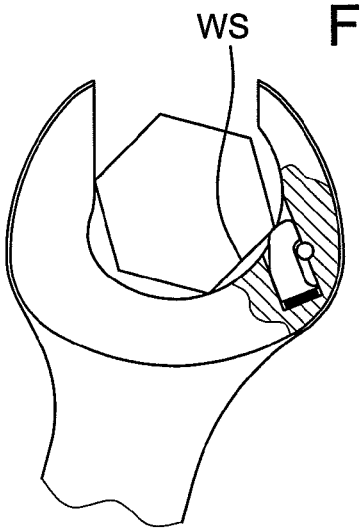
Figure 3E:
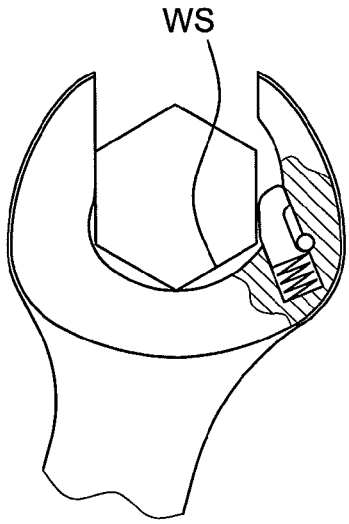

FIGS. 3A to 3E are schematic views showing how the back-ratcheting movement of ratchetable open-ended wrench 1 without loosening/tightening the workpiece W is achieved. The workpiece W is a hexagonal nut, so each back-ratcheting movement of wrench 1 around an angle of workpiece W requires a turn of 60°, as illustrated in FIGS. 3A to 3E. FIGS. 3A-3B, 3B-3C, 3C-3D and 3D-3E show the relative positions between the auxiliary jaw 140 and the contact edge WS of the workpiece W each time the wrench head 100 turns back 150. In FIG. 3A, the auxiliary jaw 140 reaches the first position in which the workpiece W does not bias the auxiliary jaw 140, with the driving surface 143 preferably close to the contact edge WS. In this position, the auxiliary jaw 140 works with the first jaw 110 to grip the nut. Accordingly, if the ratchetable open-ended wrench 1 turns in the clockwise direction, the nut can be tightened/loosened. As shown in FIG. 3B, when the ratchetable open-ended wrench 1 turns in the counterclockwise direction, the counterforce applied by the nut to the pushing surface 144 forces the auxiliary jaw 140 to retract into the auxiliary jaw retracting opening 130 and travel toward the base portion 121, in which step the auxiliary jaw 140 moves from the first position to the second position in which the auxiliary jaw 140 is in a fully compressed position closest to base portion 121. Further, as shown in FIGS. 3C to 3E, by continuing turning the wrench 1 to pass around an angle of the nut (as shown in FIG. 3D), the auxiliary jaw 140 returns to its first position (as shown in FIG. 3E) fully extended by the spring S. Thus, the wrench 1 is ready for another tightening/loosening action in the clockwise direction again.

All the above descriptions are intended to demonstrate the preferred embodiments of the present invention rather than limit the present invention. Since the present invention is not limited to the specific details described in connection with the preferred embodiments, changes to and implementations of certain features of the preferred embodiments without altering the overall basic function of the invention are contemplated within the scope of the appended claims.

What is claimed is:

1. A ratchetable open-ended wrench for turning a workpiece having a drive end with at least one pair of opposed contact edges, comprising:

a handle with a first end;

a wrench head including a base portion disposed adjacent the first end of the handle;

a first jaw extending outwardly from the base portion of the wrench head, the first jaw including a first driving wall disposed in a first plane;

a second jaw extending outwardly from the base portion of the wrench head such that the first jaw and the second jaw define a drive opening configured to receive the drive end of the workpiece, the second jaw including a second driving wall disposed in a second plane, wherein the first plane and the second plane are parallel and define the drive opening, an inner wall extending from the second driving wall toward the base portion of the wrench head and away from the drive opening, and an auxiliary jaw retracting opening extending into the second jaw from the inner wall, wherein the auxiliary jaw retracting opening has a longitudinal centerline that forms with the second plane an included angle less than 35° and has an edge parallel with the longitudinal centerline opposite the drive opening; and an auxiliary jaw including a driving surface for contacting an edge of the workpiece drive end, the auxiliary jaw being slidably received in the auxiliary jaw retracting opening between a first position in which the driving surface engages the workpiece drive end edge when the workpiece drive end is inserted in the drive opening so that the workpiece drive end edge is parallel with the second plane and a second position retracted into the auxiliary jaw retracting opening offset from the first position away from the second plane, the auxiliary jaw being shaped so that it comprises an abutment surface that engages a wall of the auxiliary jaw retracting opening at the auxiliary jaw retracting opening edge when the auxiliary jaw is in the first position, an interior end, and a limiting slot between a shoulder of the abutment surface and a shoulder of the interior end;

wherein the drive end of the workpiece is slidably receivable in the drive opening of the wrench head so that rotation of the wrench head in a first direction rotates the workpiece in the first direction either by the combination of the first driving wall and the second driving wall or the combination of the first driving wall and the driving surface of the auxiliary jaw in the first position, and wherein at least a portion of the inner wall of the second jaw that is disposed between the second driving wall and the auxiliary jaw retracting opening is disposed outwardly of the auxiliary jaw retracting opening edge with respect to the drive opening; and wherein the auxiliary jaw is disposed in the auxiliary jaw retracting opening in the first position so that when the driving surface of the auxiliary jaw engages the workpiece drive end edge and the wrench head is rotated in the first direction so that the combination of the first driving wall and the driving surface of the auxiliary jaw rotates the workpiece in the first direction, the auxiliary jaw transfers a reaction force from the workpiece drive end to the wrench head at an interface between the abutment surface and the auxiliary jaw retracting opening edge without applying torque to the auxiliary jaw about an edge of the auxiliary jaw retracting opening at the inner wall.

2. The ratchetable open-ended wrench according to claim 1, wherein the first driving wall and the second driving wall are separated by a first width that is substantially equal to a second width that separates the at least one pair of opposed contact edges of the drive end of the workpiece from each other.

3. The ratchetable open-ended wrench according to claim 2, wherein the driving surface of the auxiliary jaw is disposed within the second plane in which the second driving wall lies when the auxiliary jaw is in the first position.

4. The ratchetable open-ended wrench according to claim 2, wherein the auxiliary jaw is slidably received in the second jaw between the second driving wall and the base portion of the wrench head.

5. The ratchetable open-ended wrench according to claim 1, wherein the workpiece is rotatable by the first driving wall and the second driving wall when the drive end of the workpiece is partially received within the drive opening of the wrench head and rotatable by the first driving wall and the driving surface of the auxiliary jaw when the drive end of the workpiece is fully received within the drive opening of the wrench head.

6. The ratchetable open-ended wrench according to claim 5, wherein the inner wall of the second jaw is concave and extends from the first driving wall to the second driving wall, the inner wall being configured such that the wrench head is rotatable about the drive end of the workpiece in a second direction when the drive end is fully received within the drive opening.

7. The ratchetable open-ended wrench according to claim 6, wherein the auxiliary jaw is urged inwardly into the second jaw when the wrench head is rotated about the workpiece in the second direction.

8. The ratchetable open-ended wrench according to claim 1, wherein the limiting slot is in the form of a longitudinal notch substantially located in the auxiliary jaw and spaced a distance from the edge of the auxiliary jaw retracting opening.

9. A ratchetable open-ended wrench for turning a workpiece having a drive end with at least one pair of opposed contact edges, comprising:

a handle with a first end;

a wrench head including a base portion disposed adjacent the first end of the handle;

a first jaw extending outwardly from the base portion of the wrench head, the first jaw including a first driving wall disposed in a first plane;

a second jaw extending outwardly from the base portion of the wrench head such that the first jaw and the second jaw define a drive opening configured to receive the drive end of the workpiece, the second jaw including a second driving wall disposed in a second plane and an auxiliary jaw retracting opening extending into the second jaw, wherein the auxiliary jaw retracting opening has a longitudinal centerline and has an edge parallel with the longitudinal centerline opposite the drive opening; and an auxiliary jaw including a driving surface for contacting an edge of the workpiece drive end, the auxiliary jaw being slidably received in the auxiliary jaw retracting opening between a first position in which the driving surface engages the workpiece drive end edge when the workpiece drive end is inserted in the drive opening so that the workpiece drive end edge is parallel with the second plane and a second position retracted into the auxiliary jaw retracting opening offset from the first position away from the second plane, the auxiliary jaw being shaped so that it comprises an abutment surface that engages a wall of the auxiliary jaw retracting opening at the auxiliary jaw retracting opening edge when the auxiliary jaw is in the first position, wherein the first driving wall and the second driving wall are substantially parallel and separated by a first width that is substantially equal to a second width that separates the at least one pair of opposed contact edges of the drive end of the workpiece from each other, wherein the driving surface of the auxiliary jaw is disposed within the second plane when the auxiliary jaw is in the first position, and wherein the second driving wall of the second jaw is disposed outwardly of the auxiliary jaw retracting opening edge with respect to the drive opening;

wherein the auxiliary jaw is disposed in the auxiliary jaw retracting opening in the first position so that when the driving surface of the auxiliary jaw engages the workpiece drive end edge and the wrench head is rotated in a first direction so that the first driving wall and the driving surface of the auxiliary jaw rotate the workpiece in the first direction, the auxiliary jaw transfers a reaction force from the workpiece drive end to the wrench head at an interface between the abutment surface and the auxiliary jaw retracting opening edge without applying torque to the auxiliary jaw about an interface of the auxiliary jaw retracting opening and a wall of the second jaw that faces the drive opening and is disposed outwardly of the auxiliary jaw retracting opening edge with respect to the drive opening; and wherein a limiting slot extends from the abutment surface parallel to the auxiliary jaw opening edge.

10. The ratchetable open-ended wrench according to claim 9, wherein the drive end of the workpiece is slidably receivable in the drive opening of the wrench head such that the workpiece can be rotated in the first direction by either the combination of the first driving wall and the second driving wall or the combination of the first driving wall and the driving surface of the auxiliary jaw.

11. The ratchetable open-ended wrench according to claim 10, wherein the auxiliary jaw is slidably received in the second jaw between the second driving wall and the base portion of the wrench head.

12. The ratchetable open-ended wrench according to claim 9, wherein the facing wall of the second jaw is concave and extends from the first driving wall to the second driving wall, the facing wall being configured such that the wrench head is rotatable about the drive end of the workpiece in a second direction when the drive end is fully received within the drive opening.

13. The ratchetable open-ended wrench according to claim 8, comprising a limiting member disposed in the second jaw and extending into the limiting slot to thereby limit movement of the auxiliary jaw between the first and second positions.

14. The ratchetable open-ended wrench according to claim 9, comprising a limiting member disposed in the second jaw and extending into the limiting slot to thereby limit movement of the auxiliary jaw between the first and second positions.

15. A ratchetable open-ended wrench for turning a rotatable workpiece having a polygonal portion to receive the wrench, comprising:

an elongated handle; and a wrench head having a base portion attached to an end of the handle and having a first jaw extending from the base portion and defining a generally planar first driving wall at a distal end of the first jaw, a second jaw extending from the base portion and defining a generally planar second driving wall at a distal end of the second jaw and that is parallel to the first driving wall and spaced from the first driving wall a first distance approximately equal to a distance that separates opposing flat sides of the polygonal portion of the workpiece, wherein respective planes defined by the first driving wall and the second driving wall define a first space therebetween, within which the polygonal portion is received, wherein the second jaw has an inner wall that extends from the second driving wall outward of the first space and toward the base portion and thereby defines a second space between the first space and the inner wall, wherein the second jaw has an auxiliary jaw retracting opening that opens at the inner wall at the second space and extends therefrom toward the base portion, so that an axis of the auxiliary jaw retracting opening forms an acute angle with respect to the plane defined by the second driving wall, wherein the first jaw has a recessed portion proximate the base portion at the first space, thereby defining a third space extending between the first space and the recessed portion, and an auxiliary jaw having a driving surface and being slidably received in the auxiliary jaw retracting opening between a first position in which the driving surface is located at the plane defined by the second driving wall and the auxiliary jaw is otherwise disposed outside the first space, and a second position retracted into the auxiliary jaw retracting opening, away from the plane defined by the second driving wall, wherein when the workpiece polygonal portion is received in the first space, application of force to the handle applying torque to the wrench head in a first direction applies force from a wall of the auxiliary jaw retracting opening, and through the auxiliary jaw in the first position, to a portion of a first said flat side of the polygonal workpiece portion proximate the base portion, and applies force from the first driving wall to a portion of an opposing second said flat side of the polygonal workpiece portion away from the base portion, and application of force to the handle applying torque to the wrench head in a second direction opposite the first direction rotates the wrench head with respect to the workpiece polygonal portion so that the first flat side moves the auxiliary jaw in the auxiliary jaw retracting opening from the first position toward the second position and a corner of the workpiece polygonal portion at an end of the first flat side away from the base portion moves into the second space, and a corner of the workpiece polygonal portion at an end of the second flat side proximate the base portion moves into the third space.

16. The ratchetable open-ended wrench according to claim 15, including a limiting slot extending along an outer surface of the auxiliary jaw parallel to an axis of the auxiliary jaw retractable opening.

17. The ratchetable open-ended wrench according to claim 16, comprising a limiting member disposed in the second jaw and extending into the limiting slot to thereby limit movement of the auxiliary jaw between the first and second positions.

18. The retractable open-ended wrench according to claim 15, wherein the auxiliary jaw retracting opening is defined by a blind bore that terminates in the second jaw, and wherein the auxiliary jaw has an interior end elastically coupled to the auxiliary jaw retracting opening.

19. The retractable open-ended wrench according to claim 15, wherein the polygonal portion of the workpiece is slidably receivable in the first space so that the workpiece can be rotated by either the combination of the first driving wall and the second driving wall or the combination of the first driving wall and the driving surface of the auxiliary jaw.

* * * * *

UNITED STATES PATENT AND TRADEMARK OFFICE

CERTIFICATE OF CORRECTION

PATENT NO. : 8,631,725 B2
APPLICATION NO. : 12/136132
DATED : January 21, 2014
INVENTOR(S) : Hsien-Chung Tuan-Mu It is certified that error appears in the above-identified patent and that said Letters Patent is hereby corrected as shown below:

On the title page item (57) line 10, please change "opening 13" to -- opening 130 --

In the Specification

Column 2, line 2, please change "jaw 15 may" to -- jaw 15 and may --

Column 2, line 45, please change "devices 40, 66 is" to -- devices 40, 60 are --

Column 5, line 13, please change "fastener-jaw room 120" to -- fastener-jaw room 128 --

Column 6, line 5, please change "or of is the" to -- or of the --

Signed and Sealed this
Sixteenth Day of September, 2014

Michelle K. Lee

Michelle K. Lee
*Deputy Director of the United States Patent and Trademark Office*